United States Patent [19]

Perreton

[11] Patent Number: 4,498,266

[45] Date of Patent: Feb. 12, 1985

[54] CONCRETE BLOCK AND HOLLOW INSULATING INSERT THEREFOR

[76] Inventor: Arnold Perreton, Pleasant St. Webster, Rte. 5, Concord, N.H. 03301

[21] Appl. No.: 390,820

[22] Filed: Jun. 22, 1982

[51] Int. Cl.[3] ..... E04B 2/00

[52] U.S. Cl. ..... 52/405; 52/596

[58] Field of Search ..... 52/596, 606, 605, 405, 52/309.4, 309.8, 309.12, 309.3, 309.13, 660, 309.15, 309.16, 431, 442; 428/247, 256, 413

[56] References Cited

U.S. PATENT DOCUMENTS

| | | | |
|---|---|---|---|
| 3,204,381 | 9/1965 | Perreton | 52/405 X |
| 3,546,833 | 12/1970 | Perreton | 52/405 X |
| 3,885,363 | 5/1975 | Whittey | 52/405 X |
| 4,004,385 | 1/1977 | Kosuge | 52/405 X |
| 4,380,887 | 4/1983 | Lee | 52/405 |

*Primary Examiner*—Donald G. Kelly
*Assistant Examiner*—Naoko N. Slack
*Attorney, Agent, or Firm*—Schwartz, Jeffery, Schwaab, Mack, Blumenthal & Koch

[57] ABSTRACT

A concrete block and hollow insulating insert in which the insert has recesses and cavities formed in the interior thereof for facilitating positioning the insert over reduced height webs interconnecting the walls of the block. In one form of block construction, interconnecting webs in another region of the block are also reduced to permit longitudinal reinforcement placement and/or provide a longitudinal channel for air circulation through that region of the block.

19 Claims, 9 Drawing Figures

CONCRETE BLOCK AND HOLLOW INSULATING INSERT THEREFOR

BACKGROUND OF THE INVENTION

The present invention relates as indicated to concrete blocks and hollow insulating inserts therefor, with the inserts when used in combination with the concrete blocks providing an important insulating function, as well as other advantages.

The concept of insulating concrete block wall construction is of course well known in the art. The art has long recognized certain inherent disadvantages in the normal block wall, perphaps the most important of which are the moisture and thermal conductivity through the webs of the block, with the webs normally extending the full vertical height of the block. The voids in the block between the webs provide little insulating effect since air in the voids is constantly circulated from the warm side to the cold side of the adjoining walls. This is contrasted to absolutely still air which has substantially insulating value. Moreover, voids in the block can be accommodated only to a certain extend without diminishing the load carrying characteristics of the block.

It is also known in the art to provide plastic inserts in the block, and examples of these are disclosed in my U.S. Pat. Nos. 3,204,381, granted Sept. 7, 1965, and 3,546,833, granted Dec. 15, 1970. The concrete blocks illustrated in both of my earlier patents are provided with interconnecting web portions of reduced height, and separate insulating inserts are provided which extend over the reduced height web portions thereby reducing the moisture and thermal transmission through the block. My earlier insulating inserts are further characterized by the provision of external tongues and grooves so that adjacent and superimposed blocks can be accurately located and spaced to provide uniform horizontal and vertical mortar joints. In addition to the desirable uniform spacing of the blocks, the tongue and groove arrangement additionally provides a continuous insulating plane intermediate the side wall of the block.

Although the insulating inserts disclosed in my earlier patents have proved highly satisfactory in use, and fully accomplish the intended objectives, some degree of difficulty has been encountered with regard to maintaining the proper dimensional tolerances for a snug fitting of the inserts in the blocks. In the manufacture of the plastic inserts, which can be satisfactorily formed of polystyrene, for example, post-expansion occurs during and after molding thereby making it very difficult to uniformly adhere to the desired insert thickness, for example, 3". Where post-expansion increases the thickness even a small portion beyond the desired thickness, it is difficult to correctly position the insert in the block over and in engagement with the interconnecting web portions of the block. Since it is not desired to decrease the thickness of the inserts, which would correspondingly decrease the insulating values of the inserts, an attempt was made to correct the problem by modifying the molds for the concrete blocks. Although the modified dimensions proved initially satisfactory, the uncontrollable wearing of the molds resulted in the interconnecting or cross webs of the block increasing in thickness as the mold wore at that location. In view of the obvious cost of continually modifying the mold so as to be able to hold the proper dimension, and the noted desire of not decreasing the thickness of the insert, the problem of proper insert fit was not solved until the present invention.

SUMMARY OF THE INVENTION

The present invention solves the above noted problems by providing an insulating insert which is so shaped and constructed as to accommodate dimensional differences between the thickness of the insert and the walls and webs of the block, particularly in the region of the connecting webs. In accordance with the invention, recesses are formed of substantial transverse dimension and extend vertically at each side of the walls of the notch in the insert which receives the interconnecting webs of the block. Cavities are formed in the insert immediately above each of the web-receiving notches, with the cavities extending substantially transversely of the insert thickness. In this manner, any binding of the insert with the walls of the block immediately above the connecting webs can be accommodated by depressing the remaining wall thicknesses into the cavities formed. The previously noted recesses formed in the walls of each notch result in contact walls or ribs which are easily depressible when they come into contact with the sides of the webs, thereby accommodating any increase in web thickness due to mold wear. Thus, a snug fit is provided at all regions of contact of the insert with the block.

Another feature of the invention is that in addition to providing the highly desirable snug fitting between the insert and the block despite dimensional discrepancies, the resulting insulation characteristics are actually improved. At the location of the recesses and cavities just described, both the recesses and cavities are totally closed off thereby providing still air cavities the insulation value of which is even somewhat higher than the insulation value of the polystyrene foam. The provision of the recesses and cavities in the regions of the insert which interengage the connecting webs provides still further advantages, namely, less material is utilized thereby reducing material costs, less molding time is required, and post-expansion is essentially eliminated.

Although the binding of the insert is not a problem in those regions of the block where the thickness of the insert is of smaller dimension than the spacing between the side walls, it is nevertheless desirable to provide additional cavities in the central and end portions of the block. These cavities preferably extend from the bottom wall of the groove surface of the insert upwardly substantially toward the top of the insert. These additional cavities similarly provide the advantages of increased insulating value and reduced material and consequent cost. In this regard, the additional cavities which are open at the bottom of the groove of the insert are closed by the top rib or tongue of the insert positioned immediately therebelow. As above noted, due to the tongue and groove formation formed at the sides, top and bottom of the insert, uniform spacing is provided, and all cavities are sealed off to provide closed still air chambers.

It should further be noted that all of the above described modifications in the insert effect the internal dimensions only of the insert. The exterior dimensions remain the same, whereby the tongue and groove interlocking of adjacent and superimposed inserts is not in any way affected. Thus, the present invention retains the advantages of my prior inserts while eliminating the noted disadvantages. Concrete blocks are longitudinally staggered relative to the inserts with which they are associated, with the middle portion of the insert being positioned opposite the vertical mortar joing between adjacent blocks. Tongue and groove formations formed on the top and bottom, respectively, of the inserts permit vertically superimposed inserts to be tightly fitted together in the region of the horizontal mortar joint between superimposed blocks. Vertical tongues and grooves at the ends of each insert permit horizontally adjacent inserts to be snugly fit together. In this manner, the inserts provide a continuous vertical wall through the concrete block wall structure. This arrangement provides the following advantages:

1. Infiltration of air through the structure is prevented.

2. The inserts in combination with the concrete blocks having modified cross-webs which accommodate the inserts greatly reduces conduction through the composite wall structure. The cross-webs are approximately one half the height of the block thereby reducing the cross sectional area of the webs to approximately 10% of the total block wall. The hollow insulating insert occupies space equivalent to the remaining 90% of the wall area, thereby assuring 90% thermal insulation from the viewpoint of direct conduction, which is of course confined to the reduced web sections.

3. Both the inserts and the air spaces between the insert and the adjacent faces of the concrete shells serve as temperature barriers which prevent the convection of warm inside air to the cold side of the wall in 90% of the wall area, thus assuring 90% thermal insulation from convection losses.

4. By molding the insert in white plastic, or coating the surfaces thereof with a heat reflecting material, heat from either outside or inside is reflected back to its source, with the above mentioned wall surface areas assuring 90% thermal insulation from the standpoint of radiation.

5. The tongue and groove jointed hollow insulating inserts serves as a 1.2 perm vapor barrier in 90% of the wall area. Moreover, the air spaces between the inserts and the interior and exterior face shells of the blocks provide a water drain to remove water or moisture collected within the interior or exterior side of the block. A relatively high impermeability to rain penetration and vapor transmission or condensation is therefore provided, with test results indicating that less than 0.01% dampness appears on the interior surface of the wall after 72 hours of testing under virtual hurricane conditions. This is very important since the avoidance of moisture serves to maintain from the high insulating values of the composite wall.

If horizontal joint reinforcement is desired, the top wall of the inserts can be formed with spaced, transverse grooves in which ladder-type reinforcement can be positioned at every course of blocks, or alternative courses. The transverse sections of the reinforcement members and the grooves formed in the insert are located at the cross-web areas of the block to provide transverse reinforcement in such area. This assures a structurally sound composite wall construction, as well as a wall construction which is highly attractive in appearance due to the inherent and precise spacing of the concrete blocks by virtue of the tongue and groove construction of the inserts.

The novel insert construction can be used with 8" or 12" blocks, with use with the 12" block being illustrated in my previously referred to U.S. Pat. No. 3,546,833. In such block construction, the reduced cross-webs are formed in an 8" transverse section of the block, with the remaining section of the block comprising webs which extend vertically the entire length of the block so as to define two full-height cavities in the usual fashion. A desired modification of the construction resides in the reduction and height of the end and intermediate web sections in the 4" transverse section of the block in order to accomplish several advantageous results. The reduced webs in the 4" section as well as the 8" section which receives the insulating insert serve to reduce conduction through the webs and thus through the entire block. Further, the reduced webs in the 4" section permits horizontal, longitudinal reinforcement. Such reinforcement, in combination with concrete fill poured into the cavities of the 4" section provides a reinforced wall construction of superior strength and insulating characteristics.

The modified 12" block construction has a further advantage when the block wall structure is adapted for use with a solar heating system. In addition to the cavities in the 4" section of the block for circulation of solar-heated or mechanically-heated air vertically through the wall structure, the reduced webs in the 4" section also permit horizontal circulation of air entirely through the wall thereby adding an important dimension in terms of accommodating desired air circulation. Since the insulating inserts are located in the outer 8" section of the block, the heated circulating air is well insulated.

The 12" block constructed in accordance with the present invention is also adapted to be used with mortarless block wall structures, particularly in solar-radiant building construction. In lieu of mortar type horizontal and vertical block jointing, a coated fiberglass-reinforced metal mesh is employed for reinforcement purposes. The fiberglass-reinforced metal mesh is used in order to prevent mortar from dropping into the wall cavities, which would interfere with air circulation in the cavities. It further functions to level out any horizontal irregularities in the blocks and to reinforce the reduced cross webs. In the mortarless wall construction, the outside and inside surfaces of the wall are coated with a fiberglass bonding cement coating which seals the outer and inner surfaces of the wall. The water from the surface coating as well as any moisture within the block activates the cement on the fiberglass-coated metal mesh to provide sealing of the horizontal jointing and consequent additional structural strength to the wall. Such construction permits the horizontal and vertical circulation of either mechanically or solar-heated air, thereby adapting the wall for solar-radiant heating, with possible mechanical assistance.

These and other objects will be apparent as the following description proceeds and particular reference to the application drawings.

DETAILED DESCRIPTION OF THE APPLICATION DRAWINGS

DETAILED DESCRIPTION OF THE PREFERRED EMBODIMENTS

Figure 1:
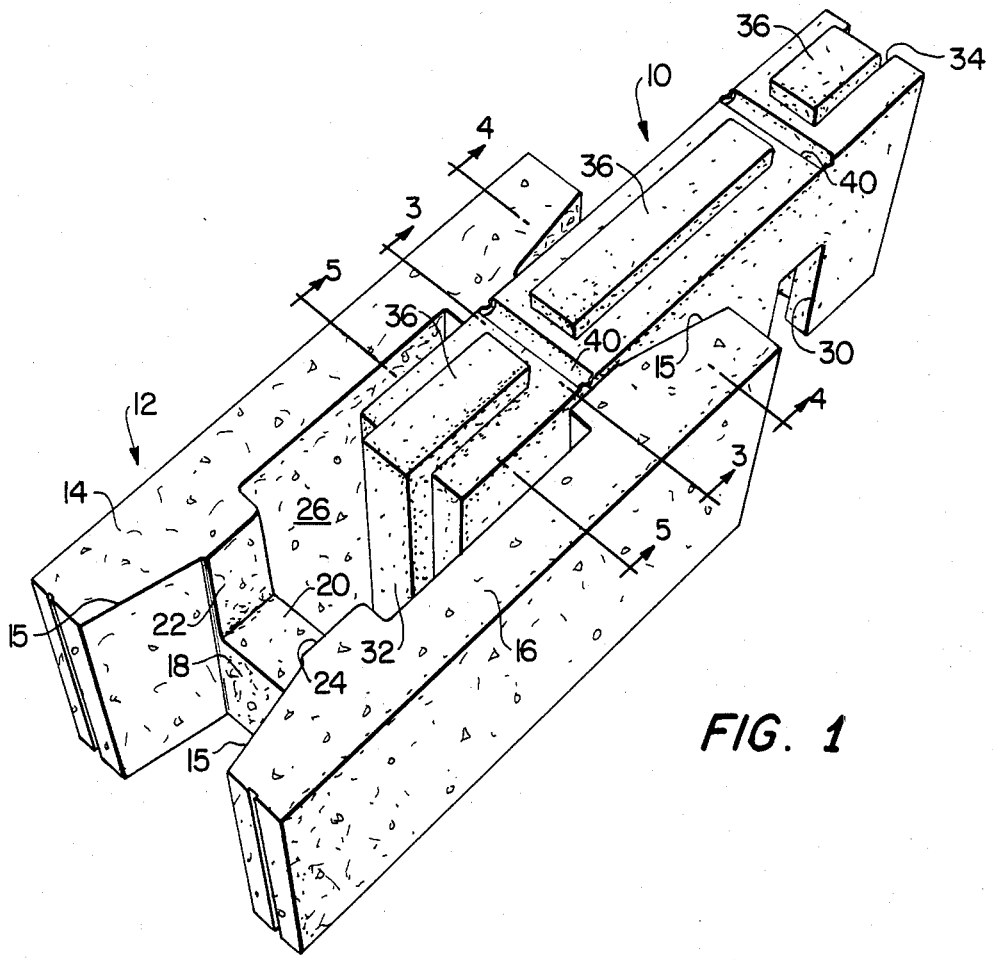
FIG. 1 is a perspective view of a building block and insulating insert positioned therein and constructed in accordance with the present invention.

Referring now in detail to the drawings, wherein like parts are indicated by like reference numerals, and initially to FIGS. 1-5, the insulating insert constructed in accordance with the present invention is generally indicated at 10 and is shown in its properly positioned location with respect to the building block generally indicated at 12. It will be noted that the insert extends longitudinally approximately intermediate the length of the block, and it will be understood that a similar insert is adjacently positioned in the block cavities and over the other interconnecting web in the same manner as the insert shown, and as will be hereinafter described in more detail. It is preferred that the blocks of each superimposed row are longitudinally staggered relative to the blocks in the row below, and the inserts are correspondingly staggered from row to row.

The block 12 comprises side walls 14 and 16 and interconnecting webs commonly designated at 18, only one of which is visible in FIG. 1. It will be noted that the webs are vertically truncated, extending from the bottom of the block to a point approximately intermediate the height of the block to provide a flat top surface 20. The surface 20 and the surfaces of the adjoining walls 22 and 24 define an opening which receives a corresponding notch 30 of the insulating insert 10. The notch 30 has a dimension corresponding closely to the thickness of the web 18, with the notch receiving the web when the insert is properly positioned in the block. In the form shown, the block has a center cavity 26, and the ends of the side walls 14 and 16 are tapered outwardly at their inner surfaces as shown at 15 to provide a second area of clearance with the insert.

The problem which the present invention addresses can best be described by reference to the connecting web 18 and the adjoining faces 22 and 24. The concrete block is molded in the usual fashion, and during the molding operation, mold wear is inevitable. Such wear results in the thickness of the web 18 being increased, and the surfaces 22 and 24 expanded inwardly. While this would be of no consequence if insulating inserts were not used conjunctively with the blocks with fairly close tolerances involved, the thickening creates dimensional discrepancies with the block insert which make it very difficult to position the insert in place. Moreover, as above noted, this problem is further magnified by the difficulty to adhere to dimensional tolerances during the manufacturing of the foam insert. Although in the form shown the insert is preferably 3" thick, post-expansion occurs during and after molding, thereby slightly increasing the thickness of the insert which is relatively rigid. It is undesirable to reduce the thickness of the insert since it significantly adversely affects the insulating characteristics of the composite block assembly. As a result, there are two factors of dimensional instability which are cumulative, thereby causing binding during insertion of the insert into the block.

Reference is now made to the details of construction of the insert 10. Exteriorally, the insert is comparable in shape and function to the insulating insert shown in my earlier U.S. Pat. No. 3,546,833. The insert is integrally molded of plastic material, preferably polystyrene of two pound density, and two notches commonly designated at 30 are formed at longitudinally spaced locations in the insert, reference being made to FIG. 2 which shows the location of the notches. The notches are open at the bottom of the insert, and the vertical dimension of the notches as defined by the top wall thereof closely approximates the height of the connecting web 18 of the block, which web is received in the notch when the insert is installed, reference being made to FIG. 3.

One end of the insert is formed with a projection or tongue 32, and the opposite end is formed with a groove 34 of comparable depth whereby adjacently disposed inserts can be tightly fitted in a tongue and groove arrangement. Similar tongue portions commonly designated at 36 are integrally formed and project from the top surface of the insert, and a groove 38 of comparable depth and width is formed in the bottom of the insert. The groove sections are continuous except at the regions of the notches 30, and receive the tongue sections 36 of a vertically aligned insert. This arrangement can best be seen in FIGS. 4 and 5, which shows superimposed inserts and blocks. Thus, each insert is adapted to tightly fit longitudinally adjacent inserts, or inserts positioned above or below the insert, thereby providing a continuous wall of insulation between the side walls of the blocks. If metal reinforcing members are to be utilized during construction of the wall for strengthening the same (see FIG. 6), grooves commonly designated at 40 can be formed in the top surface of the insert where indicated in FIG. 1. If reinforcement is not provided, the grooves 40 can obviously be eliminated.

Figure 2:
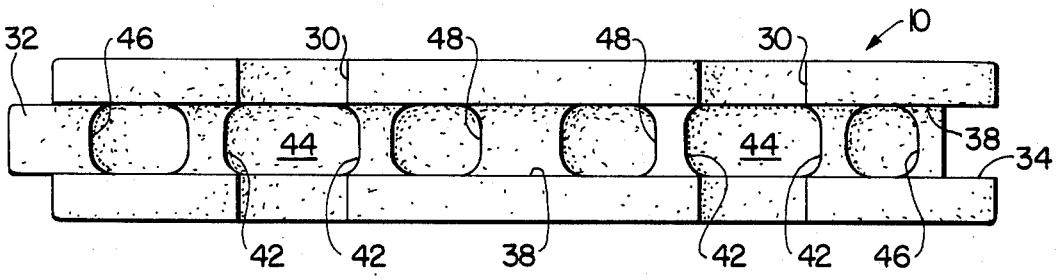
FIG. 2 is a bottom plan view of the insulating insert, showing the recesses and cavities formed therein.
Figure 3:
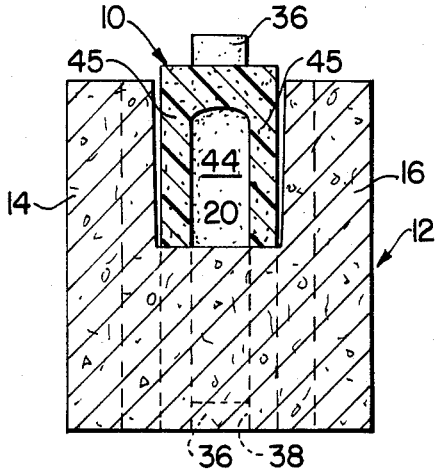
FIG. 3 is a vertical sectional view taken on line 3—3 of FIG. 1.
Figure 4:
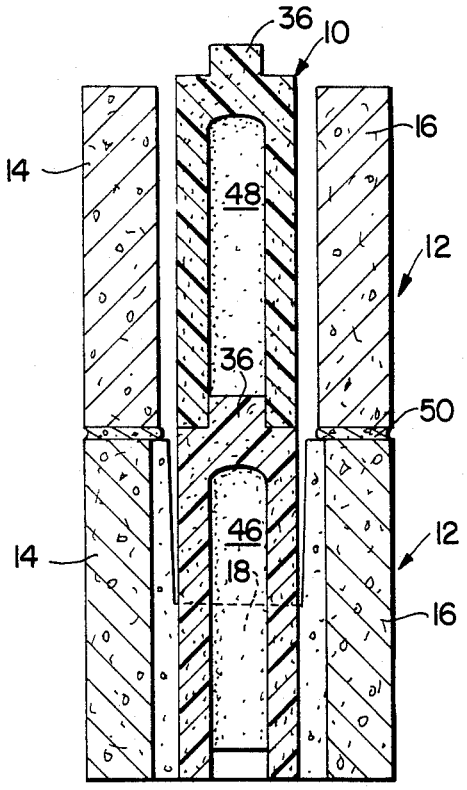
FIG. 4 is a vertical sectional view taken on line 4—4 of FIG. 1.
Figure 5:
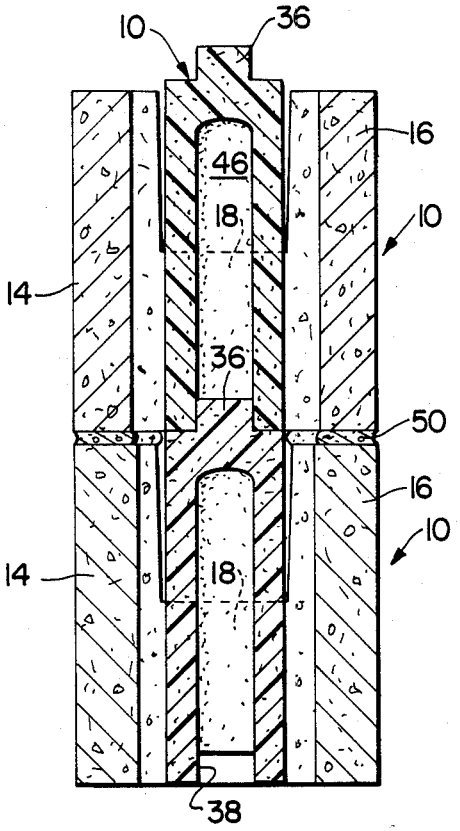
FIG. 5 is a vertical sectional view taken on line 5—5 of FIG. 1.

Referring now to the modifications of the insert which comprise the present invention, the recesses and cavities are shown in the bottom plan view of FIG. 2, and these recesses are also illustrated in the sectional views constituting FIGS. 3-5. Referring to FIG. 2, the side walls of each notch are recessed as shown commonly at 42, and a cavity 44 is formed above the notch extending relatively adjacent the top wall of the insert, as shown in FIG. 3. The provision of the recesses 42 and the cavity 44 accomplishes the following results. If dimensional instability due either to mold wear or insert thickness in the region of the connecting webs and/or notches occurs, the cavity 44 permits the adjoining walls 45 (FIG. 3) of the insert to be compressed inwardly by the adjoining walls 22 and 24 above the web 18 thereby permitting the desired snug fitting of the insert in such region. In the absence of the cavity 44, substantial binding was previously encountered as above described due to the dimensional differences described. The second area of relief is provided by the recesses 42. In the event the thickness of the connecting web 18 increases due to mold wear, the vertical walls of the notch to either side of the recesses 42 can be compressed inwardly toward the recesses, again permitting the walls of the notch to tightly fit against the outside faces of the connecting web 18. Thus, regardless of the dimensional instability referred to, the insert can be properly located without difficulty, thereby avoiding costly mold modification of the block or undesirable reduction of the thickness of the insert.

Additional cavities commonly indicated at 46 are formed in the insert, each located between a notch 30 and the adjacent insert end. These cavities 46 extend from the bottom of the groove 38 to a point relatively closely adjacent the top of the insert, with the vertical extent of the cavities being shown in FIG. 5. It will be noted that these cavities are closed at the bottom by the tongue sections 36 of the insert positioned below, thereby providing a still air cavity having excellent insulating characteristics.

Similar cavities 48 are formed generally centrally of the insert between the notches 30, with the cavities 48 likewise extending from the bottom groove 38 to a point relatively closely adjacent the top of the insert, reference being made to FIG. 4. Again, the tongue sections 36 of the insert below seals off the cavities to provide insulating chambers.

The cavities 46 and 48 are not necessary to alleviate the binding problem referred to above, which occurs only in the area of the notches 30, but there are several advantages accruing through formation of the cavities. First of all, substantial material saving is realized when compared with molding an insert which is solid except for the notches. Secondly, due to the thinner mass of the walls in the regions of the cavities, the molding process is facilitated and post-expansion essentially eliminated. This is true with regard to the recesses and cavities 42 and 44, respectively, as well. If slight expansion does take place in the regions of the notches, the insert is more readily compressible as above mentioned. Thirdly, each cavity and recess is completely sealed by the insert below, thereby providing still air chambers possessing high insulating values. In fact, the combination of the still air chambers and the polystyrene provides an overall higher insulating value than the polystyrene alone. Importantly, this improved insulation characteristic does not in any way detract from the structural integrity of the insert. The cavities and recesses formed have a total volume such that the structural rigidity of the inserts is not significantly affected.

FIGS. 3–5 are taken on sectional lines through the insert and blocks so as to show the sealing of the cavities and the relationship of the inserts one to the other and to the blocks in which they are inserted. In FIGS. 4 and 5, superimposed blocks and inserts are illustrated, with the tongue and grooved mating relationship of the inserts being apparent, so as to illustrate a typical section of a composite wall structure. In both of these figures, mortar is illustrated at 50 between and bonding superimposed blocks, and it will be understood that mortar is used at all block joints. It will further be understood, in accordance with my earlier patents, that the dimensions and alignment of the inserts are such that the blocks are automatically aligned during construction of the wall, a very desirable feature in terms both of construction and esthetics.

Figure 6:
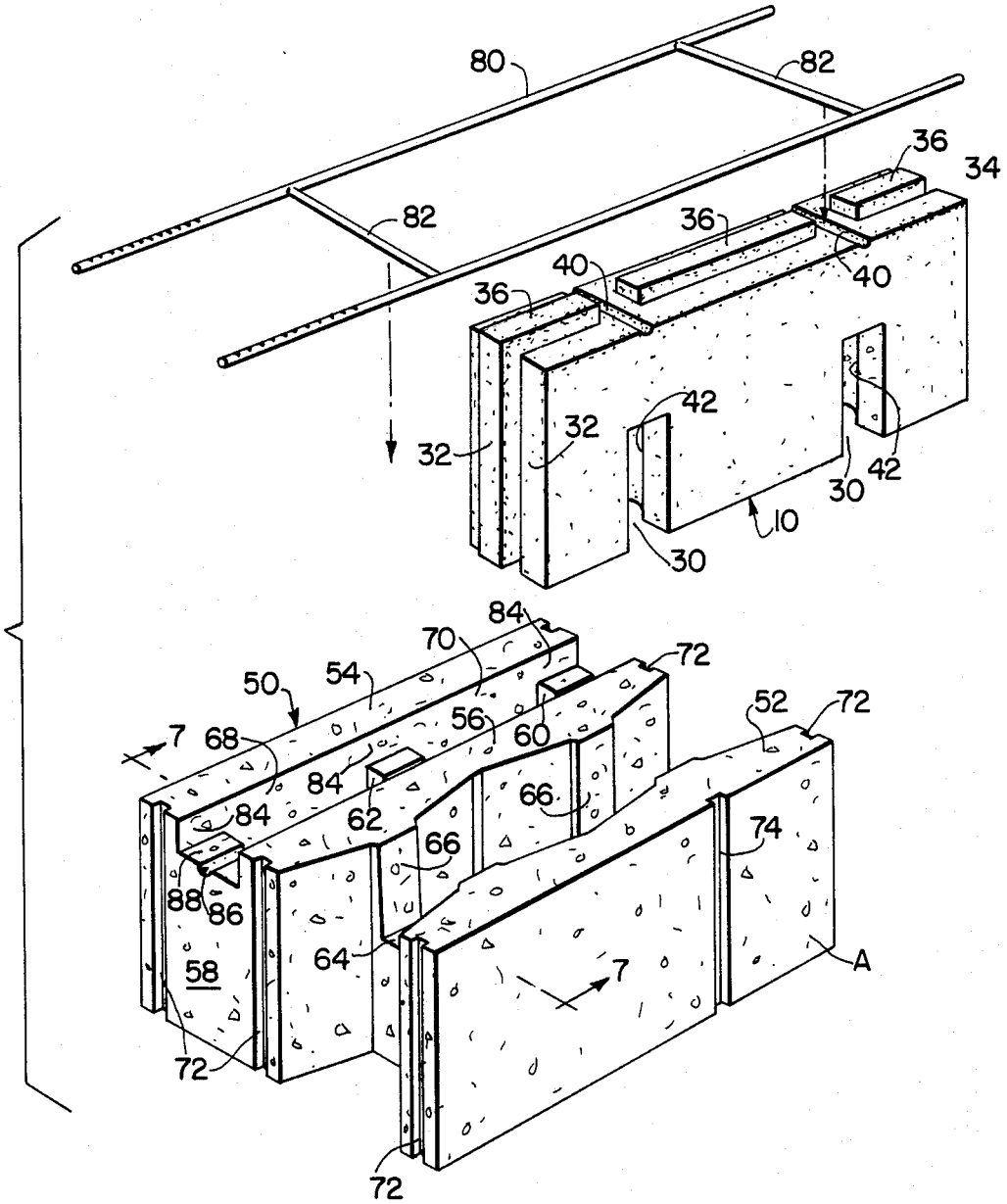
FIG. 6 is an exploded perspective view of a 12" block, hollow insulating insert, and reinforcing member.

As above noted, the hollow insulating insert constructed in accordance with the present invention can be used either with the normal 8" block, or the specially formed 12" block illustrated in my U.S. Pat. No. 3,546,833. Referring now to these figures, the hollow insulating insert shown in FIG. 6 is identical in all respects to the inserts shown in FIGS. 1–5, with only the recesses 42 being shown in FIGS. 6 and 7. For sale of clarity, the cavities 44, 46 and 48 have not been illustrated in FIG. 6.

The 12" block is generally indicated at 50, and is comparable in most respects to the block shown in my earlier patent. Thus, the block includes the side walls 52 and 54, and an intermediate wall 56 comparably shaped to the outer wall 52. The side wall 54 and intermediate wall 56 are connected by the end webs 58 and 60, and intermediate web 62, all of which are of reduced height as will be presently described. Intermediate web sections 64, only one of which is visible in FIG. 6, interconnect the side wall 52 and intermediate wall 56, and are longitudinally staggered relative to the webs 58, 60 and 62. Upwardly and outwardly inclined wall portions 66 extend upwardly from the top surface of the shortened webs 64 to facilitate insertion of the insert 10, in the same manner as the block shown in FIG. 1.

The webs 58, 60 and 62 define therebetween cavities 68 and 70. If maximum structural characteristics are desired for the wall, these cavities can be filled with concrete and reinforced vertically, by reinforcing rods or the like. Alternatively, the cavities 68 and 70, if left open, provide for vertical circulation of heated air through the wall, thereby particularly adapting the system to solar heating systems.

In the form shown, the vertical surface of each wall 52, 54 and 56 at each end thereof is formed with a groove or recess commonly indicated at 72 which provides additional joint volume for mortar thereby improving the mechanical locking between adjacently disposed blocks. A vertical recess 74 is also formed in the exterior face of the outside wall 52 for esthetic reasons, and the exposed side wall 12 can if desired be formed with exposed aggregate particles commonly designated at A. The exposed aggregate and recesses 74 provide an esthetically pleasant wall face.

As previously described, grooves 40 are formed in the top wall of the insert to receive a metal reinforcing member if strengthening of the wall construction is desired. The reinforcing member is shown in FIG. 6 at 80 and includes transverse wire sections 82 which are spaced so as to be positioned in the grooves 40 during construction of the wall. The longitudinal sections of the reinforcement are disposed on the top surface of the walls 52 and 56 to either side of the insert 10 and are embedded in the horizontal mortar joint during construction of the wall. The grooves 40 are positioned above the notches 30 thereby giving reinforcement to the block wall in the regions of the reduced webs 64.

Figure 7:
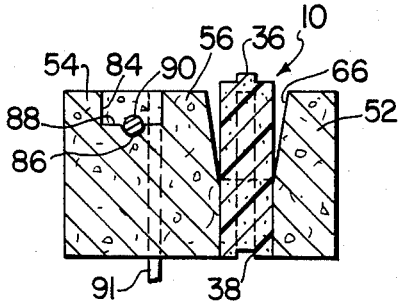
FIG. 7 is a vertical sectional view taken on line 7—7 of FIG. 6.

Each interconnecting web 58, 60 and 62 has a recess commonly designated at 84 formed in the top thereof, extending down approximately 1" from the surface of the walls 54 and 56. A central groove 86 generally semicircular in cross section is formed in the bottom wall 88 for receiving a reinforcing rod 90, reference being made to FIG. 7. In this manner, if maximum strength is desired, horizontal reinforcing rods can be placed in the grooves in addition to reinforcing rods being disposed vertically through the adjacent cavities, and concrete subsequently poured in the cavities, to a level above the reinforcement rods. This reinforcement, in combination with the reinforcing members 80, provides excellent strength for foundation walls and earthquake wall construction. FIG. 7 illustrates horizontal reinforcing rod 90 in addition to reinforcing rod 91, extending vertically through cavity 68. Concrete is poured to the top of the recess 84. It will be understood that concrete also fills the other recesses 84, and also the cavities 68 and 70, thereby providing a concrete-filled 4" section possessing maximum strength. In addition, the concrete-filled section functions to absorb more heat from the interior and from interior sun exposure, with such absorbed heat being radiated to the interior when interior temperatures are cooler. A more thermally efficient wall is therefore provided.

The recesses 84 provide a further important advantage, particularly in mortarless block wall structures. With the increased use of solar heating, efforts have been made to provide air circulation through the exterior block wall, and the recesses 84 provide added flexibility for air circulation. In addition to accommodating vertical circulation of the air through the cavities 68 and 70, air is able to circulate horizontally through the block construction through the recesses 84. Thus, solar heated air assisted by mechanically heated air if necessary or desired, can be directed in both directions through the 4" section of the wall, which is the innermost portion of the block construction. This provides desired flexibility in air circulation in order to accommodate most efficiently a particular installation. The insulating inserts 10 are positioned in the outer 8" section of the wall between walls 52 and 56, whereby the heated air circulating through the cavities 68 and 70 and/or horizontally through the recesses 84 is substantially fully insulated. As above noted, the combined insert and block construction reduces conduction, convection and radiation through the wall, with the recesses formed in the cavity even further improving the insulating characteristics of the insert by the provision of still air chambers as above described.

In mortarless wall constructions, only the outside and inside surfaces of the wall are coated, preferably with fiberglass surface-bonding cement, which seals the block wall. In such construction, an epoxy-covered, fiberglass-reinforced metal mesh is preferably used in lieu of the reinforcing member 80. This type of reinforcement is preferred in order to avoid mortar dropping into the cavities of the wall which would otherwise interfere with the air circulation in the cavities. The fiberglass-reinforced mesh also functions to cushion and level out any irregularities in the blocks and to reinforce the cross webs in the block as above described. When the epoxy-covered fiberglass-reinforced metal mesh is employed, the water from the cement coating for the outside and inside surfaces of the wall, together with the moisture within the block, activates the epoxy cement to provide sealing of the horizontal jointing and additional structural strength to the wall. The normal horizontal and vertical mortar joints between blocks are entirely eliminated in accordance with this modification. The elimination of the mortar joints is made possible by the tongue and grooved hollow insert construction which provides an exacting spacing means for the blocks, as above described. The combination of the uniquely constructed block as shown in FIG. 6, the mortarless fiberglass jointing, and the novel hollow insulating insert provide a highly effective insulated wall adapted especially for use in solar-radiant building construction.

Figure 8:
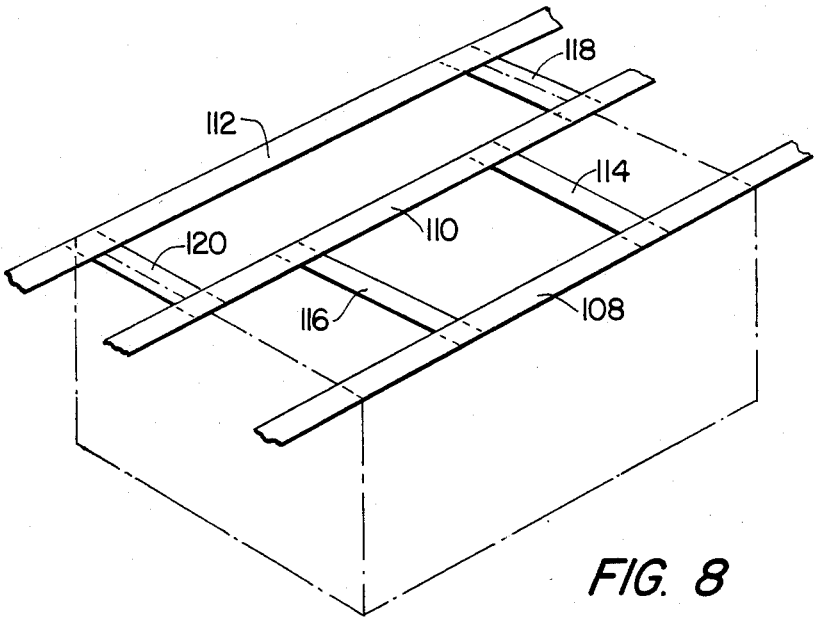
FIG. 8 is a partially diagrammatic perspective view showing fiberglass reinforced mesh positioned on a 12" block shown in dashed lines.
Figure 9:
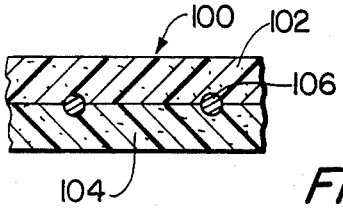
FIG. 9 is a fragmentary vertical sectional view through the reinforced mesh shown in FIG. 8.

A preferred form of fiberglass-reinforced mesh is shown applied to a diagrammatically illustrated 12" block in FIG. 8, with this block being shown in dashed lines for purposes of simplicity. A fragmentary vertical cross sectional view of the reinforced mesh is shown in FIG. 9, generally indicated at 100. The reinforcing strip comprises top and bottom fiberglass layers 102 and 104, respectively, with wire mesh 106 being positioned between the fiberglass layers. The fiberglass can be secured to the metal mesh core in any suitable manner, for example, by fusing, with the adjoining surfaces of the layers 102 and 104 being bonded together, and the layers tightly wrapped around the mesh 106. As above noted, the fiberglass is preferably either impregnated with or covered by an epoxy cement, with the cement being activated in the presence of moisture to provide sealing of the horizontal jointing between block layers for providing additional structural strength to the wall. This form of joint is particularly adaptable to mortarless radiant block wall constructions where the adjoining and vertically superimposed blocks are not mortared in the normal fashion, but, rather, the outside and the inside surfaces of the block wall are coated with fiberglass surface-bonding cement coating for sealing the wall. The moisture from such cement coating, in addition to the inherent moisture in the wall will serve to activate the epoxy cement covering or impregnating the fiberglass layers 102 and 104 for additional bonding with the blocks.

The manner in which the fiberglass joint reinforcement is positioned on the top surface of the 12" block is shown in FIG. 8, and reference is made thereto. The reinforcement is preferably produced in long strips, and shorter strips are cut to fabricate the joint reinforcement for the block. In FIG. 8, the longitudinally extending strips are designated 108, 110 and 112, respectively, with the strips 108 and 110 being interconnected by transverse strip sections 114 and 116, and the strips 110 and 112 being interconnected by transverse strips 118 and 120. The transverse strips can be secured to the longitudinally extending strips under compression and heat, for example, to fuse the strips together at designated longitudinal intervals. The transverse strips 114 and 116 are spaced so as to coincide with the notches 64 formed in the 8" section of the 12" block shown in FIG. 6, thereby adding reinforcement in those areas. These strips 118 and 120 are positioned so as to overlap the end of the block shown in FIG. 8, and the blocks positioned longitudinally at either end of the block. In this manner, the strips equalize any irregularities in the height of the two adjoining blocks, in addition to providing reinforcement at the juncture of the blocks. Although no criticality has been established for the dimensions of the reinforcing strips 100, excellent results have been obtained where the total thickness of the strip is 1/16" thick and $\frac{3}{4}$" wide.

It will be understood that the reinforcing strips are applied following insertion of the inserts in the 8" block section as shown in FIG. 6, with the cross strips 114 and 116 being positioned in the spaces between the tongue sections 36 (FIG. 6) of the insert. In such event, the reinforcing member 80 shown in FIG. 6 would not of course be applied.

It will thus be seen that the reinforcing strips 100 perform two important functions in mortarless wall constructions. First, they perform the important function of bonding between superimposed blocks, in the absence of the normal mortar joints. Secondly, they are of sufficient thickness to provide a leveling means for the wall construction, with leveling means normally being provided by varying the thickness of the mortar joint.

Although the reinforcement shown in FIG. 8 is used with a 12" block, it will be apparent that strips 108, 110, 114 and 116 could alone be used for 8" block construction. Also, if sufficient bonding can be obtained, the wire mesh can be eliminated, leaving bonded layers 102 and 104. Further, although only epoxy cement has been referred to, it will be understood that other suitable types of thermosetting bonding materials could be employed as well.

The polystyrene insert 10 used in both the 8" and 12" block forms illustrated preferably is white in color or has a coated heat-reflecting surface which serves to reflect heat in the inside wall back to its source, or radiant heat from outside of the wall back to the outside. Since the hollow insert occupies approximately 90% of the interior area of the wall, thermal insulation from radiation to that extent is provided. Moreover, the tongue and groove jointed hollow insulating inserts serve as 1.2-perm vapor barrier in 90% of the wall area, with the air spaces between the inserts and the adjacent walls of either form of block serving as a water drain to remove water or moisture collected within the interior or exterior side of the hollow block. This assures a high impermeability against rain penetration and vapor transmission or condensation. Tests have shown that little or no dampness appears on the interior surface of the wall, thereby assuring a permanent thermally insulated wall since little if any moisture is present to degrade the hollow inserts.

In summary, the present invention is novel in several respects and provides significant advantages over the prior art. The hollow insulating insert is constructed so as to be properly positioned in the concrete block, in either the 8" or 12" forms thereof, without binding, thereby alleviating the tolerance problem noted above with regard to both the block and insert. This adaptability is without sacrifice to the other desirable features of the insert, including the ability to interconnect adjacent and vertically superimposed hollow inserts to provide a solid insulating wall which occupies 90% of the wall area of the concrete block wall construction. In the 12" block illustrated and described, a further dimension is provided in that notches or recesses are formed in the interconnecting webs in the main 8" section of the block to accommodate horizontal reinforcement or to provide horizontal openings through which heated air can circulate. In a solar-radiant heating system, air is thus able to circulate both horizontally and vertically in that portion of the block inside the wall of insulation, thereby providing a highly efficient thermally insulated system. Where maximum reinforcement is desired, reinforcement can be provided by both the horizontal reinforcement in the notched areas of the block, as well as vertical reinforcement members extending vertically within the cavities, and further by reinforcing members positioned at the top of each block. Where reinforcement is employed interiorally of the block wall, concrete is poured into the cavities. In either type of installation, the insulating walls comprised of the individual tongue and groove connected hollow insulating inserts reduces conduction, convection, and radiation to a very high degree, approximately 90% of the wall area of the block in which the inserts are positioned, and a high degree of impermeability is also achieved. By virtue of the interconnection of the inserts, a mortarless block wall construction can also be achieved, and this arrangement is particularly adaptable to solar-radiant heating systems. A novel reinforcement is provided for bonding superimposed blocks where regular mortar joints are not employed.

It will be apparent that variations from the above description will be obvious to those skilled in the art without, however, departing from the concepts of the present invention. For example, although polystyrene has been referred to above and is the desired plastic material, other plastics having the necessary structural and insulating characteristics could alternatively be employed. In addition, the recesses and cavities formed in the hollow insulating inserts need not be of the identical size and shape shown, although the recesses and cavities in the region of the notches must be of sufficient size to eliminate the binding of the insert when positioned over the reduced web portions of the block.

I claim:

1. A hollow insulating insert adapted to be used with a building block to form a composite wall structure, said insert comprisng:

(a) top, bottom, side and end walls, (b) at least two longitudinally spaced notches formed in the bottom wall of the insert extending transversely through the insert and terminating at a point generally intermediate the height of the insert, each of said notches being defined by opposed side walls and a top wall, (c) a recess formed in each side wall of said notch extending the full height thereof, the portions of the side walls of said notch on either side of said recesses being adapted to be compressed into said recesses during installation of said insert, and (d) cavities formed in said insert extending upwardly from and communicating with said notch, said cavities terminating at their upper ends at a point relatively adjacent the top wall of the insert, the side walls of the insert which partially define said cavities being adapted to be compressed into said cavities during installation of said insert, said recesses and cavities being tightly sealed when said insert is located in position so as to form still air chambers.

2. The insulating insert of claim 1 further including additional cavities formed in the interior of said insert between said notches and the respective ends of said insert, each of said additional cavities communicating at its lower end with said bottom wall of said insert and opening therethrough, and terminating at the upper end thereof relatively adjacent the top wall of said insert, said additional cavities being tightly sealed when said insert is located in position with other inserts so as to form still air chambers.

3. The insulating insert of claim 1 further including additional cavities formed interiorly of said insert between said notches, each of said additional inserts communicating with the bottom wall of said insert and extending therethrough, and terminating at the top thereof relatively adjacent the top wall of said insert, said additional cavities being tightly sealed when said insert is located in position with superimposed inserts so as to form still air chambers.

4. The insulating insert of claims 1, 2 or 3, further including tongue means formed on the top and one of the end walls of said insert and projecting therefrom, and grooves formed in the bottom and other end wall of said insert, said grooves having a width and depth comparable to the width and thickness of said tongue means, whereby when inserts are superimposed and longitudinally adjacently disposed one to the other, said tongue means of said top wall extend into grooves formed in the bottom wall of a superimposed insert, and said tongue means extending from said one end wall of said insert extends into a complimentary groove formed in the longitudinally adjacent insert, thereby to provide a tight and longitudinally aligned series of inserts.

5. A composite building block and insert, said building block comprising longitudinally extending and transversely spaced first and second side walls and a longitudinally extending intermediate wall generally coextensive in length with and spaced transversely from said side walls, a plurality of transversely extending web sections interconnecting said side walls respectively with said intermediate wall, said web sections including two end webs and an intermediate web between said first side wall and said intermediate wall and defining therewith a pair of longitudinally spaced vertical cavities, said web sections being recessed at the top thereof to a point substantially below the top surfaces of said first side wall and said intermediate wall, thereby defining a horizontal, longitudinally extending passage between vertical courses of blocks to permit air to be circulated horizontally through horizontally aligned blocks; the remainder of said web sections comprising a pair of webs extending between said intermediate wall and said second side wall and serving as the sole connection therebetween, said last mentioned pair of web sections being longitudinally staggered relative to said web sections between said intermediate web and said first side wall and interconnected to said intermediate wall substantially midway of said cavities, the longitudinal staggering of said plurality of webs serving to minimize heat and moisture transmission transversely of said block, said remaining web sections being reduced in height to adapt the same to receive insulating inserts adapted to be positioned between said second side wall and said intermediate wall, a hollow insulating insert adapted to fit between said second side wall and said intermediate side wall, said insert having top, bottom, side and end walls and being formed with notches extending upwardly from the bottom thereof, said notches being longitudinally spaced and vertically dimensioned so as to receive said web sections of said block which are reduced in height and which extend between said intermediate wall and said second side wall, and means formed on said insert for permitting adjacent and superimposed inserts to be tightly fitted to said insert to form a continuous vertical wall of insulation when courses of blocks are aligned to form a block wall, and wherein each of said notches formed in said insert is defined by opposed side walls and a top wall, a recess formed in each side wall of said notch extending the full height thereof, the portions of said side walls of said notch on either side of said recesses being adapted to be compressed into said recesses during installation of said insert.

6. The building block of claim 5 wherein each recess formed in each web section extending between said first side wall and said intermediate wall is formed with a groove in the bottom wall thereof adapted to receive reinforcement means which can extend through said block and adjacently aligned blocks for longitudinally reinforcing a wall formed of said blocks.

7. The combination of claim 5 further including longitudinal reinforcing means adapted to overlie said intermediate wall and said second side wall and including transverse, longitudinally spaced reinforcing sections.

8. The combination of claim 7 wherein said reinforcement means comprises a ladder-type steel rod reinforcing member the longitudinal sides of which overlie said intermediate wall and said second side wall, said insulating insert being formed with grooves to receive said transverse sections of said reinforcing member, with said reinforcing member being adapted to be embedded in between superimposed blocks to provide wall reinforcement.

9. The combination of claim 7 wherein said reinforcement means comprises an epoxy-coated, fiberglass-reinforced metal mesh.

10. The combination of claim 5 further including cavities formed in said insert, each cavity extending upwardly from and communicating with said notch and terminating at its opposite end at a point relatively adjacent the top wall of the insert, the side walls of the insert which partially define said cavities being adapted to be compressed into said cavities during installation of said insert, said cavities being tightly sealed when said insert is located in position with superimposed inserts so as to form still air chambers.

11. The combination of claim 10 further including additional cavities formed in the interior of said insert between said notches and the respective ends of said insert, each of said additional cavities communicating at its lower end with said bottom wall of said insert and opening therethrough, and terminating at the upper end thereof relatively adjacent the top wall of said insert, said additional cavities being tightly sealed when said insert is located in position with other inserts so as to form still air chambers.

12. The combination of claim 11 further including additional cavities formed interiorly of said insert between said notches, each of said additional inserts communicating with the bottom wall of said insert and extending therethrough, and terminating at the top thereof relatively adjacent the top wall of said insert, said additional cavities being tightly sealed when said insert is located in position with superimposed inserts so as to form still air chambers.

13. The combination of claim 5 wherein said insert is formed with tongue means on the top and one of the end walls and which project therefrom, and grooves formed in the bottom and other end wall, said grooves having a width and depth comparable to the width and thickness of said tongues, whereby when inserts are superimposed and longitudinally adjacently disposed one to the other, said tongue means on said top wall extend into grooves formed in the bottom wall of a superimposed insert, and said tongue means extending from said one end wall of said insert extends into a complimentary groove formed in the longitudinally adjacent insert, thereby to provide a tight and longitudinally aligned series of inserts.

14. The combination of claim 5 further including horizontal reinforcing means extending longitudinally through said recesses formed in said web sections of said block extending between said first side wall and said intermediate wall, and vertical reinforcing means in said vertical cavities between said first side wall and said intermediate wall, thereby adapting the block to receive concrete in said cavities and covering said webs, thus providing a concrete filled section of greater strength and heat absorption and radiation capability, and an adjoining insulated section.

15. A composite building block and insert, said block comprising longitudinally extending and transversely spaced side walls, a pair of webs extending between said walls, said webs being reduced in height, a hollow insulating insert adapted to fit between said side walls and being formed with notches extending upwardly from the bottom thereof, said notches being longitudinally spaced and vertically dimensioned so as to receive said web sections of said block, each of said notches being defined by opposed side walls and a top wall, a recess formed in each side wall of said notch extending the full height thereof, the portions of said side walls of said notch on either side of said recesses being adapted to be compressed into said recesses during installation of said insert.

16. The combination of claim 15 further including cavities formed in said insert, each cavity extending at one end through a top wall of the notch and terminating at its opposite end at a point relatively adjacent the top wall of the insert, the side walls of the insert which partially define said cavities being adapted to be compressed into said cavities during installation of said insert, said cavities being tightly sealed when said insert is located in position with superimposed inserts so as to form still air chambers.

17. The combination of claim 16 further including additional cavities formed in the interior of said insert between said notches and the respective ends of said insert, each of said additional cavities communicating at its lower end with said bottom wall of said insert and opening therethrough, and terminating at the upper end thereof relatively adjacent the top wall of said insert, said additional cavities being tightly sealed when said insert is located in position with other inserts so as to form still air chambers.

18. The combination of claim 17 further including additional cavities formed interiorly of said insert between said notches, each of said additional inserts communicating with the bottom wall of said insert and extending therethrough, and terminating at the top thereof relatively adjacent the top wall of said insert, said additional cavities being tightly sealed when said insert is located in position with superimposed inserts so as to form still air chambers.

19. The combination of claim 15 wherein said insert is formed with tongue means on the top and one end wall and which project thereform, and grooves formed in the botton and other end wall, said grooves having a width and depth comparable to the width and thickness of said tongues, whereby when inserts are superimposed and longitudinally adjacently disposed one to the other, said tongue means on said top wall extend into grooves formed in the bottom wall of a superimposed insert, and said tongue means extending from said one end wall of said insert extends into a complimentary groove formed in the longitudinally adjacent insert, thereby to provide a tight and longitudinally aligned series of inserts.

* * * * *